US005955692A

United States Patent [19]

Hayashi

[11] Patent Number: 5,955,692

[45] Date of Patent: Sep. 21, 1999

[54] PERFORMANCE SUPPORTING APPARATUS, METHOD OF SUPPORTING PERFORMANCE, AND RECORDING MEDIUM STORING PERFORMANCE SUPPORTING PROGRAM

[75] Inventor: Ryutaro Hayashi, Hamura, Japan

[73] Assignee: Casio Computer Co., Ltd., Tokyo, Japan

[21] Appl. No.: 09/093,499

[22] Filed: Jun. 8, 1998

[30] Foreign Application Priority Data

Jun. 13, 1997 [JP] Japan ..... 9-171209

[51] Int. Cl.[6] ..... A63H 5/00; G04B 13/00; G10H 7/00

[52] U.S. Cl. ..... 84/609; 434/307 A

[58] Field of Search ..... 84/609, 634; 434/307 A

[56] References Cited

U.S. PATENT DOCUMENTS

| | | | |
|---|---|---|---|
| 4,454,797 | 6/1984 | Amano . | |
| 4,506,580 | 3/1985 | Koike . | |
| 5,063,820 | 11/1991 | Yamada | 84/609 |
| 5,453,569 | 9/1995 | Saito et al. | 84/609 |
| 5,621,182 | 4/1997 | Matsumoto | 84/634 X |
| 5,728,960 | 3/1998 | Sitrick | 84/601 X |
| 5,750,912 | 5/1998 | Matsumoto | 84/609 |
| 5,827,988 | 10/1998 | Wachi | 84/609 |

*Primary Examiner*—Jeffrey W. Donels
*Attorney, Agent, or Firm*—Frishauf, Holtz, Goodman, Langer & Chick, P.C.

[57] ABSTRACT

Data representing the actual performance presented by a player is analyzed on the basis of given model performance data. Data of the virtual performance played by a virtual competitor is generated in accordance with the analysis result. Automatic performance based on the virtual performance data enables the player to compare his/her performance with the performance of the virtual competitor. Thus, the player can compete with the virtual competitor or compare his/her musical technique with that of the virtual performer even if the player practices the performance alone.

21 Claims, 18 Drawing Sheets

FIG.17

NOTE MATCHING RATE:

| |
|---|
| MATCH |
| WRONG KEY DEPRESSION |
| EXTRA KEY DEPRESSION |
| KEY DEPRESSION FAILURE |

SOUND TIMING:

| |
|---|
| FREQUENCY DISTRIBUTION OF DIFFERENCES |
| AVERAGE OF DIFFERENCES |
| DEVIATION OF DIFFERENCES |

VELOCITY:

| |
|---|
| FREQUENCY DISTRIBUTION OF DIFFERENCES |
| AVERAGE OF DIFFERENCES |
| DEVIATION OF DIFFERENCES |

NOTE LENGTH(NOTE-OFF TIMING):

| |
|---|
| FREQUENCY DISTRIBUTION OF DIFFERENCES |
| AVERAGE OF DIFFERENCES |
| DEVIATION OF DIFFERENCES |

PERFORMANCE SUPPORTING APPARATUS, METHOD OF SUPPORTING PERFORMANCE, AND RECORDING MEDIUM STORING PERFORMANCE SUPPORTING PROGRAM

BACKGROUND OF THE INVENTION

1. Field of the Invention

The present invention relates to a performance supporting apparatus and a method of supporting a performance, and a recording medium storing a performance supporting program, for improvement of a player's musical performance techniques.

2. Description of the Related Art

A keyboard instrument having indicators for guiding key-on timings, for example, is known as a performance supporting apparatus. Those indicators are comprised of light emitting elements such as LEDs and arranged so as to correspond to the keys. The indicators are lit in accordance with key-on timings in a tune. A user can play the tune by depressing keys indicated by the indicators lit in accordance with the progress of the tune. An instrument which indicates that a key needs to be depressed only when a player depress a wrong key, or when playing is stopped for a predetermined period of time, is also known as a performance supporting apparatus. One of the advantages stemming from the use of such an apparatus is that a player can practice alone without attending a music class.

Practicing alone, however, often reduces the player's motivation or desire to improve his/her performance technique, because he/she cannot compete with that of others or compare his/her technique with others', unlike in the case of group training in a music class.

SUMMARY OF THE INVENTION

It is an object of the present invention to enable a player to compete with a virtual competitor in musical performance or compare his/her performance technique with that of the virtual competitor when the player practices performance alone.

According to one aspect of the present invention, a performance supporting apparatus comprises:

model performance data receiving means for receiving model performance data;

actual performance data receiving means for receiving actual performance data corresponding to a player's actual performance;

performance data analyzing means for analyzing the actual performance data received by said actual performance data receiving means, on the basis of the model performance data received by said model performance data receiving means; and virtual performance data generating means for generating virtual performance data in accordance with a result of the analysis performed by said performance data analyzing means.

According to another aspect of the present invention, a performance supporting method comprises steps of:

receiving model performance data;

receiving actual performance data corresponding to a player's actual performance;

analyzing the actual performance data received by said actual performance data receiving step, on the basis of the model performance data received by said model performance data receiving step; and generating virtual performance data in accordance with the result of the analysis performed by said performance data analyzing step.

According to still another aspect of the present invention, a recording medium storing a performance supporting program which enables a computer to:

receive model performance data;

receive actual performance data corresponding to a player's actual performance;

analyze the received actual performance data on the basis of the received model performance data; and generate virtual performance data in accordance with the result of the analysis.

According to those structures, data of virtual performance played by a virtual competitor can be generated in accordance with an analysis of performance data actually played by a player, on the basis of model performance data. The player can compare his/her performance with that of the virtual competitor while playing an instrument to the accompaniment of an automatically played performance in accordance with virtual performance data. Thus, the player can compete with the virtual competitor or compare his/her performance with that of the virtual competitor.

BRIEF DESCRIPTION OF THE DRAWINGS

FIG. 17 is a diagram showing matters to be calculated by the actual performance analyzing process.

DETAILED DESCRIPTION OF THE PREFERRED EMBODIMENT

Figure 1:
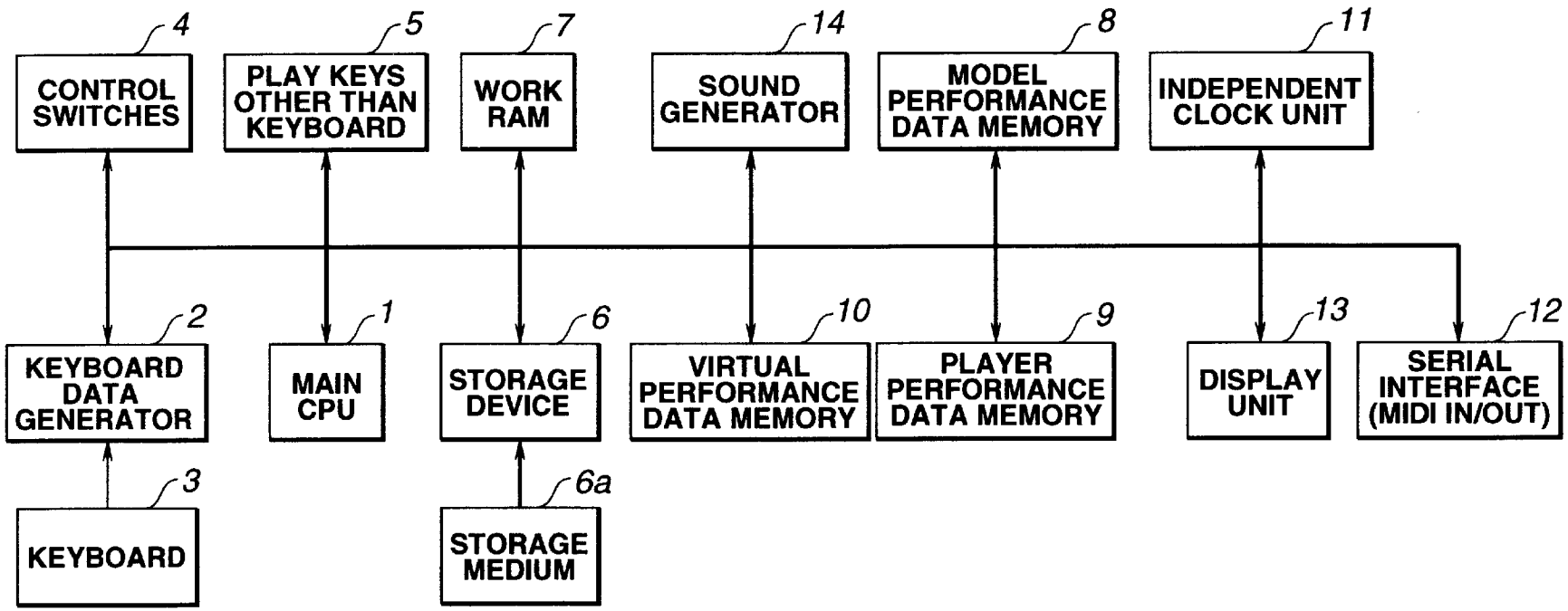
FIG. 1 is a block diagram showing a system of an electronic keyboard instrument according to an embodiment of the present invention.

An embodiment of the present invention will now be described in connection with an electronic instrument having a keyboard, with reference to FIGS. 1 to 18. FIG. 1 is a block diagram showing a system of the electronic instrument according to the present embodiment, FIGS. 2 to 13 are flowcharts for explaining operations performed by a CPU 1 in the electronic instrument, and FIGS. 14 to 18 are diagrams showing data stored in memory devices and an analysis of actual playing (described later).

As shown in FIG. 1, a system bus connects the CPU 1 to various elements including a keyboard data generator 2, a keyboard 3, control switches 4, play keys 5, a storage device 6, a work RAM 7, a model performance data memory 8, a player performance data memory 9, a virtual performance memory 10, an independent clock unit 11, a serial interface 12, a display unit 13, and a sound generator 14. The CPU 1 sends commands to those elements and receives data from them, and controls the whole of the electronic instrument. The keyboard data generator 2 inputs note data corresponding to a key number, velocity and note duration to the CPU 1 in accordance with key depressions on the keyboard 3. The control switches 4 include switches for controlling pitch vending, modulation, MIDI on/off, and the like. The play keys 5 other than the keyboard 3 include switches for inputting a play mode, note characters and other play conditions.

The storage device 6 has a storage medium 6*a* which stores an operating program for the CPU 1 and initial data for initializing the CPU 1. The storage medium 6*a* may be comprised of a magnetic storage medium, an optical storage medium, or a semiconductor memory device such as a ROM. The storage medium 6*a* may be fixed to the storage device 6 or detachably attached to the storage device 6. The program, data or the like to be stored in the storage medium 6*a* may be received from other devices via a communication network. Moreover, the storage device having the storage medium may be connected to another device, and the electronic instrument may use the program, data or the like stored in the storage device via the communication network.

The work RAM 7 temporarily stores data input from the keyboard 3 or the like. The work RAM 7 has various registers necessary for temporary storing of data, and stores flags. The model performance data memory 8 stores data representing a model performance. The model performance data memory 8 is a non-volatile memory which can store input MIDI data. The player performance data memory 9 stores data representing the actual performance played by a player (a user). The virtual performance memory 10 stores data representing the virtual performance executed by a virtual competitor. The virtual performance data is renewed in accordance with the actual performance executed by the player. The player performance data memory 9 and the virtual performance memory 10 are not non-volatile memory devices. However, the memories 9 and 10 are backed up so that the data can be preserved after the instrument is turned off.

The independent clock unit 11 counts real time and outputs the period of time from the start to end of a play. The serial interface 12 is used for transmission/reception of MIDI data to/from external MIDI devices. The display unit 13 displays the play mode and other play status. The sound generator 14 generates or mutes sounds on the basis of commands from the CPU 1 and the note data read out from the work RAM 7.

Figure 14:
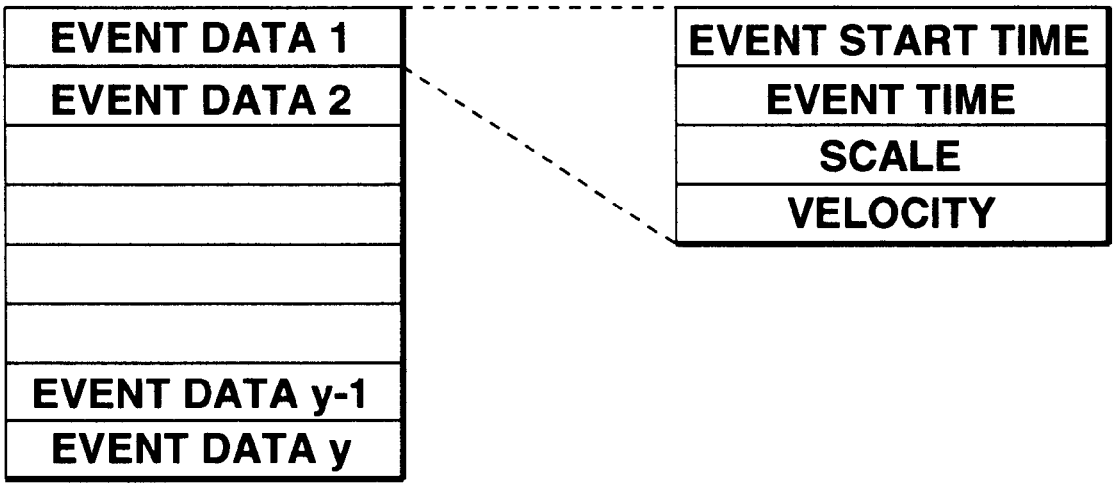
FIG. 14 is a diagram showing the structure of the event data stored in each of memories.

Operations of the electric instrument according to the embodiment will now be described. In actual use, key-on and key-off often occur simultaneously. For easy understanding, however, this embodiment will be explained for a case where the keys are depressed one by one. As shown in FIG. 14, event data comprises event start time, event time (note duration), pitch data (note number) and velocity data.

Figure 2:
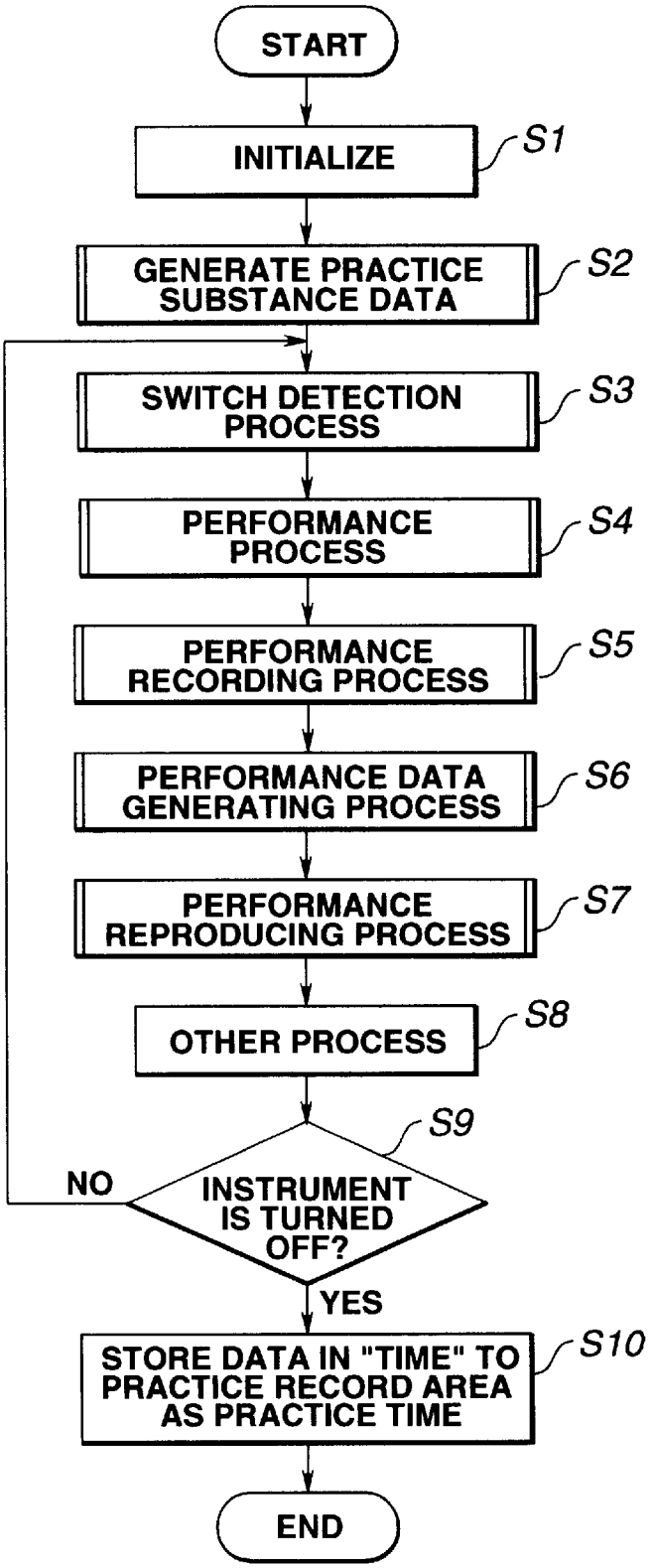
FIG. 2 is a flowchart showing a main flow executed by a CPU shown in FIG. 1.
Figure 3:
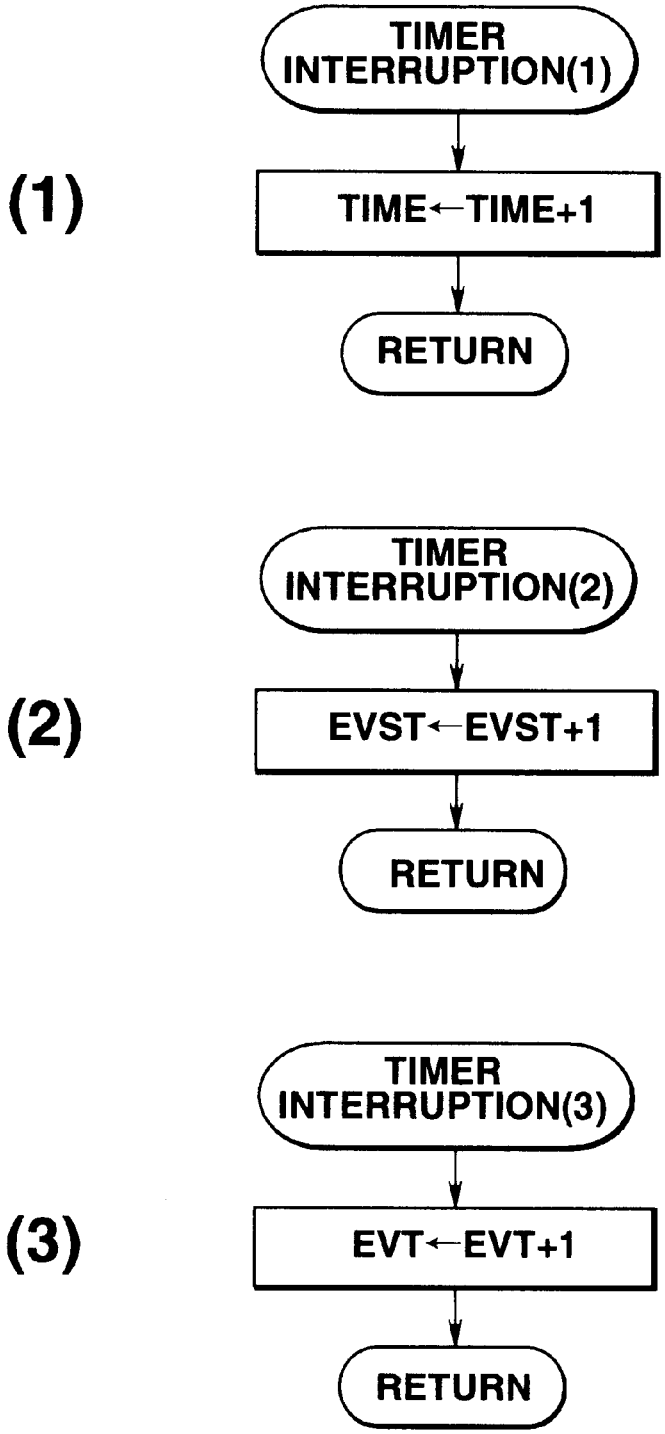
FIGS. 3A, 3B and 3C are flowcharts for explaining a timer interruption process.
Figure 3A:
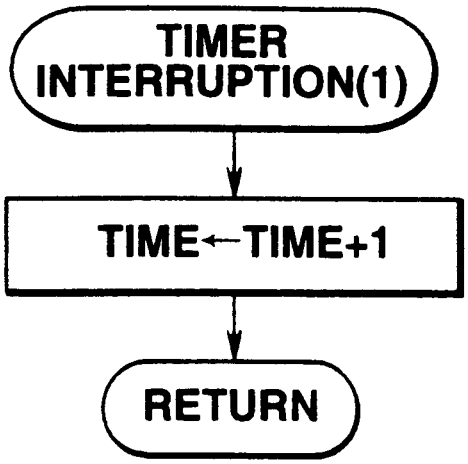
Figure 3B:
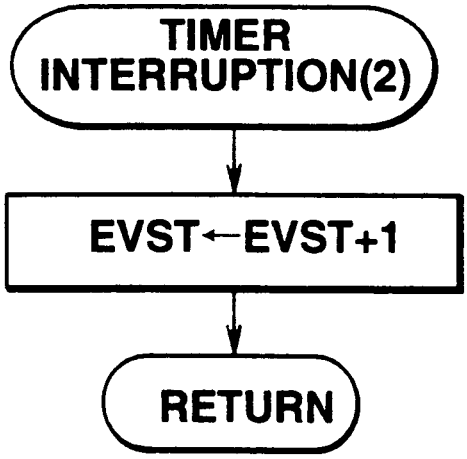
Figure 3C:
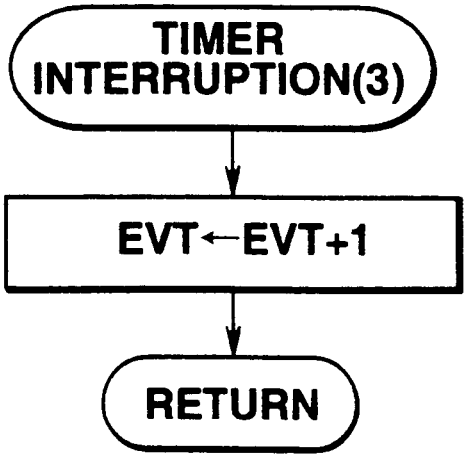
Figure 4:
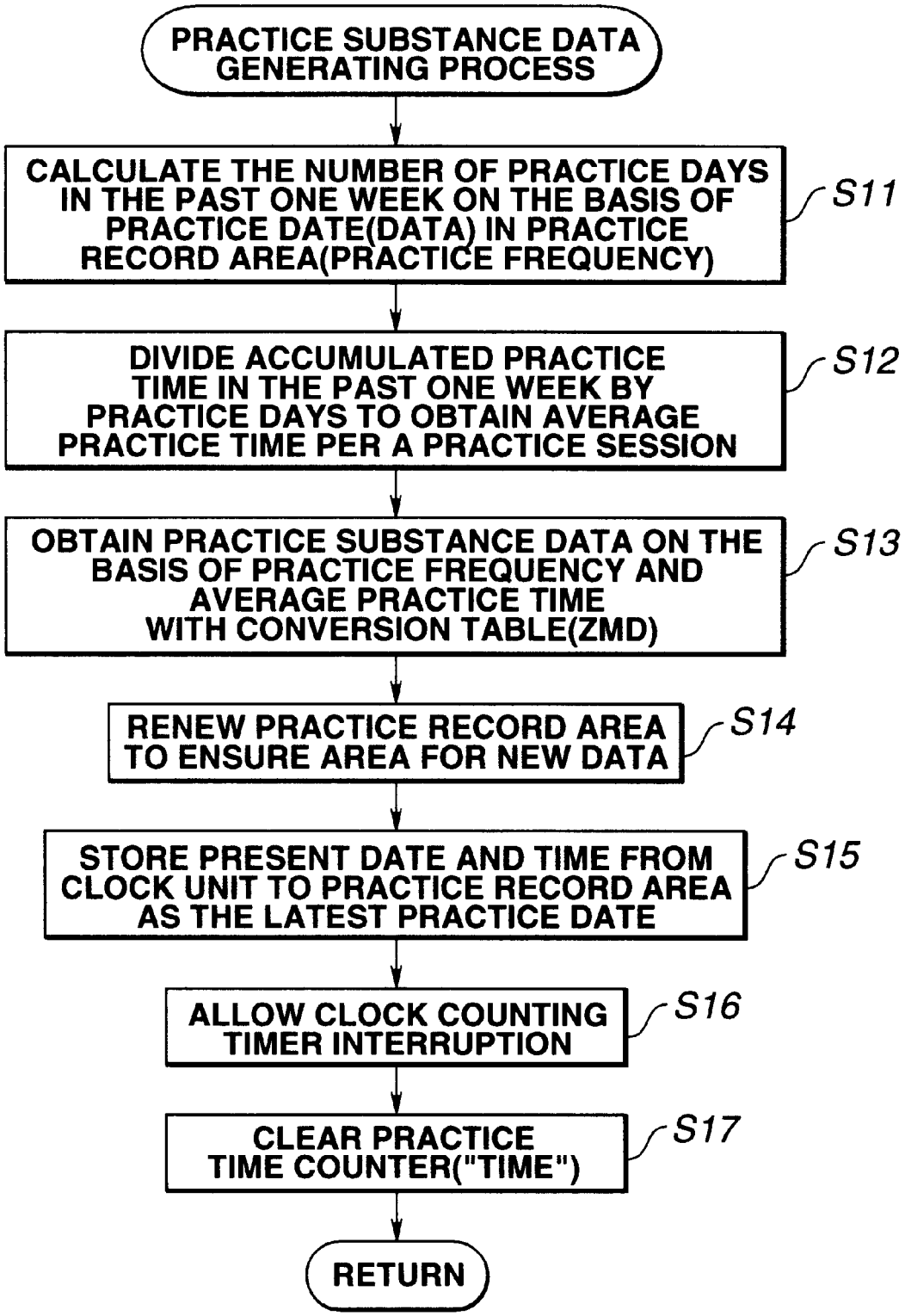
FIG. 4 is a flowchart for explaining the practice substance data generating step included in the flowchart shown in FIG. 2.
Figure 15:
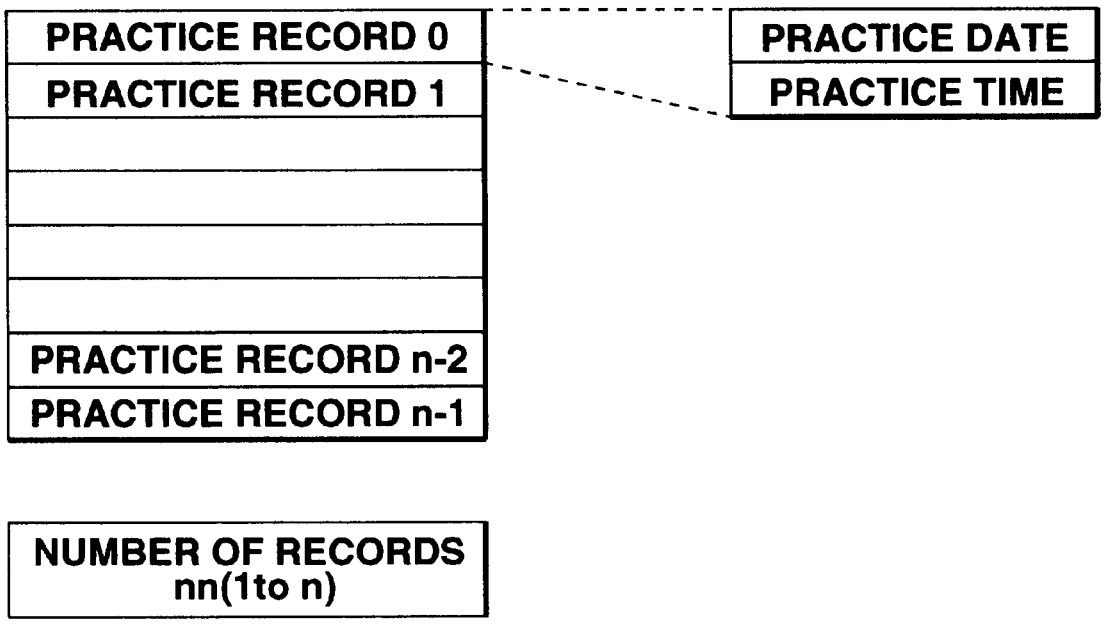
FIG. 15 is a diagram showing data segments stored in the practice record area of a player's performance data memory.

FIG. 2 is a flowchart showing the main flow of a process to be executed by the CPU 1. FIGS. 3A to 3C are flowcharts showing a timer interruption process. FIGS. 3A to 3C show three kinds of interrupting operations. FIG. 3A shows the case where counted practice time is set to a register TIME. FIG. 3B shows the case where counted event start time is set to a register EVST. FIG. 3C shows the case where counted event time (note duration) is set to a register EVT. In the main flow shown in FIG. 2, a predetermined initialization step (step S1) and a practice substance (density) data generating step (step S2) are executed. In the practice substance data generating step, as shown in FIG. 4, the number of days on which the player has practiced playing in the past one week is calculated on the basis of the date of practice stored in a practice record area in the player performance data memory 9 (step S11). As shown in FIG. 15, the practice record stored in the practice record area has data segments of practice dates and practice time in each day. As shown in FIG. 4, the CPU 1 calculates accumulation of practice time in the past one week. The CPU 1 divides the accumulated value by the number of days on which the player has practiced playing, to obtain average time per practice (step S12).

Figure 16:
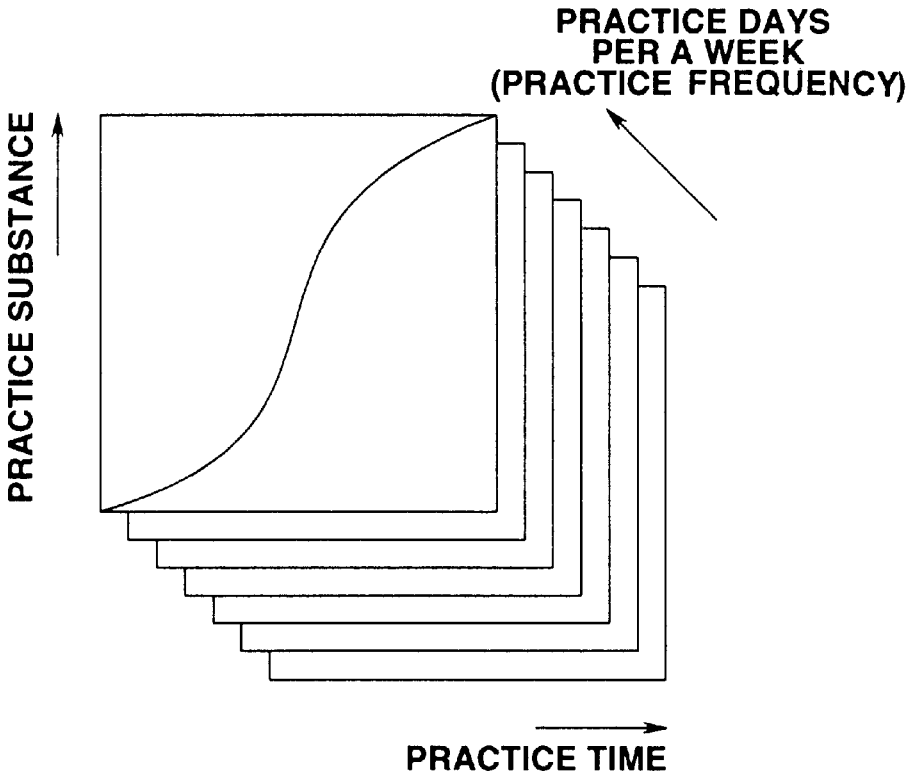
FIG. 16 is a diagram showing a conversion table for obtaining practice substance from the practice time of the actual performance.

Then the CPU 1 obtains practice substance data based on practice frequency and the obtained average time, with reference to a conversion table shown in FIG. 16. The CPU 1 stores the obtained practice substance data in a register ZMD of the work RAM 7 (step S13). The CPU 1 updates the practice record area shown in FIG. 15 so as to store new data (step S14). The CPU 1 obtains the present date and time from the clock unit 11 and stores them in the practice record area of the player performance data memory 9 as the latest date and time of practice (step S15). Then the CPU 1 allows an interruption based on a time count timer (step S16) and clears a practice time counter (TIME) in the work RAM 7 (step S17). Then the flow returns to the main flow shown in FIG. 2.

After the flow returns to the main flow, the processes to be executed, that is, the switch detection process (step S3), the performance process (step S4), the performance recording process (step S5), the performance data generating process (step S6), the performance reproducing process (step S7) and any other process (step S8), are conducted. After step S8 is executed, it is determined by step S9 whether the electronic instrument has been turned off or not. If the CPU 1 determines that the instrument has not been turned off, the flow returns to step S3 so as to repeat steps S3 to S9. If the CPU 1 determines that the instrument has been turned off, the CPU 1 stores the counted practice time in the practice record area of the player performance data memory 9 as the latest practice time (step S10).

Figure 5:
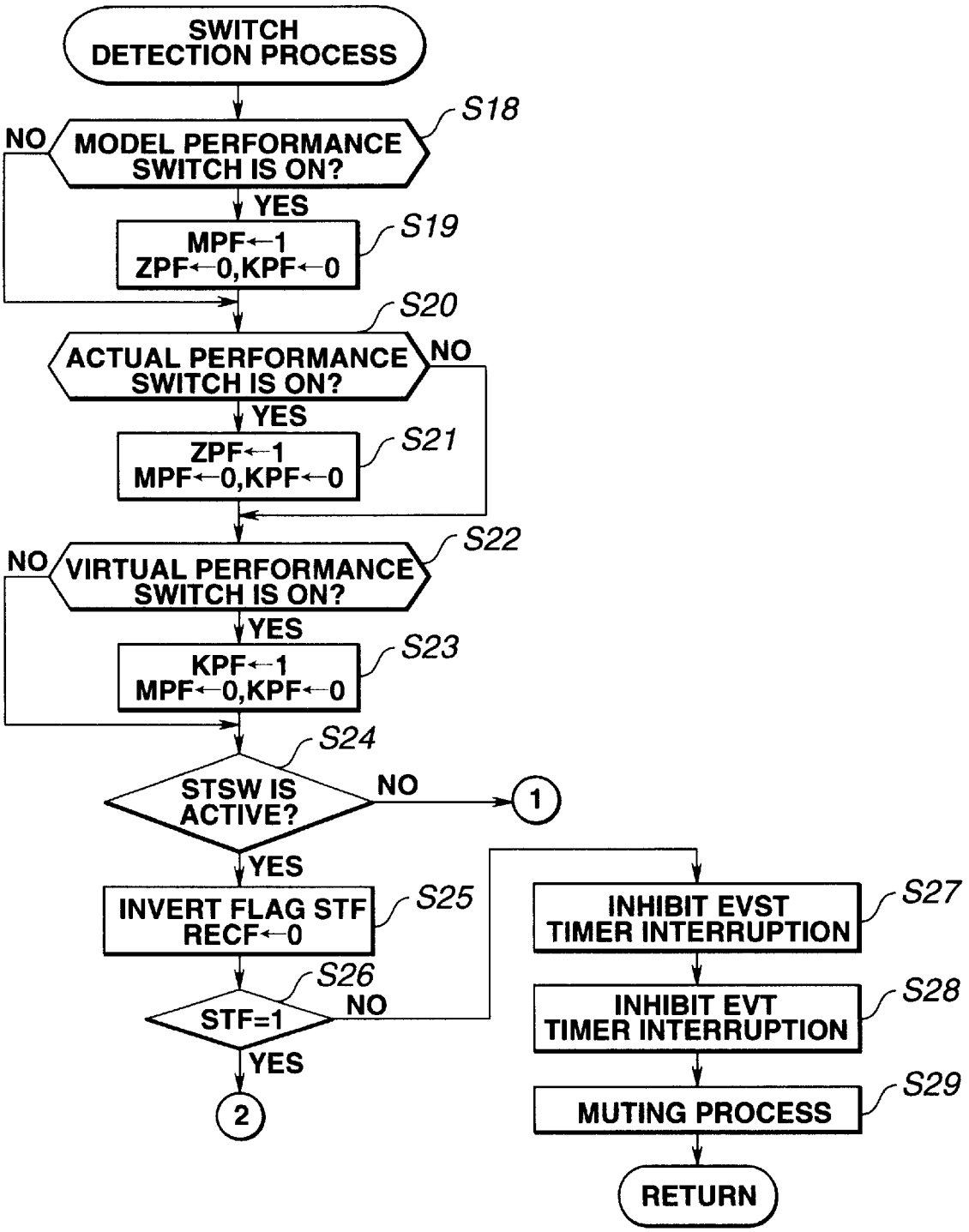
FIGS. 5 to 7 are flowcharts for explaining the switch detection step included in the flowchart shown in FIG. 2.

In the switch detection process by step S3 in the main flow, the CPU 1 detects ON or OFF of a model performance switch, an actual performance switch, a virtual performance switch and a start switch of the play keys 5. As shown in FIG. 5, the CPU 1 determines whether the model performance switch is in the ON state or not (step S18). If the CPU 1 determines that the model performance switch is in the ON state, a model performance flag MPF is set at "1", and an actual performance flag ZPF and a virtual performance flag KPF are reset at "0" (step S19). In this case, the play mode of the instrument is set at a model performance mode.

Then the CPU 1 determines whether the actual performance switch is ON or not (step S20). If the CPU 1 determines that the actual performance switch is ON, the flag ZPF is set and the flags MPF and KPF are reset (step S21). In this case, the play mode is set at an actual performance mode.

Then, the CPU 1 determines whether the virtual performance switch is ON or not (step S22). If the virtual performance switch is ON, the flag KPF is set, and the flags MPF and ZPF are reset (step S23). In this case, the play mode is set at a virtual performance mode.

The CPU 1 determines whether the start switch is ON or not (step S24). If the CPU 1 determines that the start switch is ON, the CPU 1 inverses a start flag STF, and a record flag RECF is reset (step S25). The CPU 1 determines whether the flag STF is set or not (step S26). If the CPU 1 determines that the flag STF is reset, the CPU 1 inhibits EVT timer interruption shown in FIG. 3B (step S27) and inhibits EVST timer interruption shown in FIG. 3C (step S28). Then the CPU 1 commands the sound generator 14, which is a sound source, to mute the sound (step S29).

Figure 6:
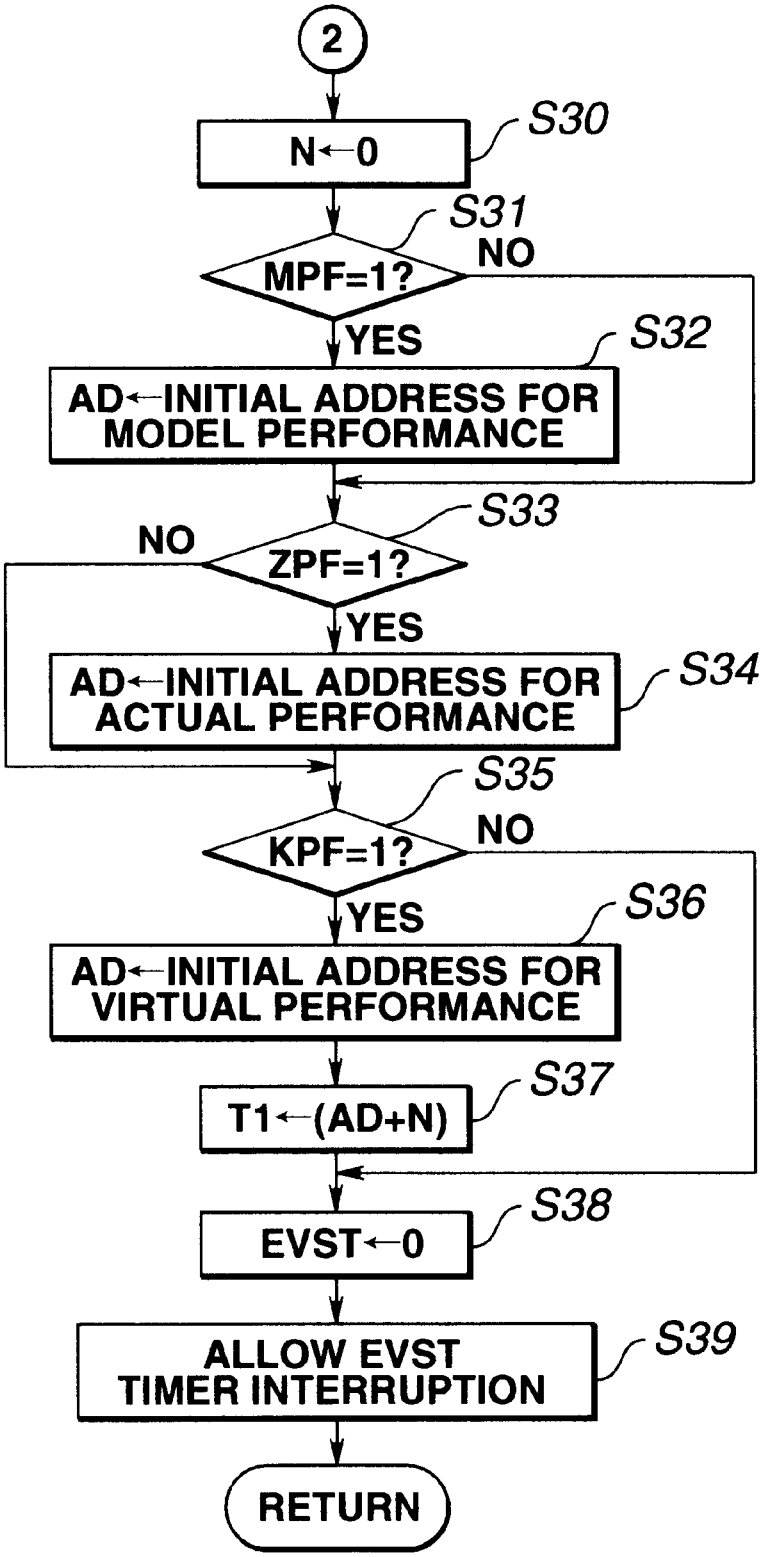

If the CPU 1 determines by step S26 shown in FIG. 5 that the flag STF is set, that is, performance is started, the flow progresses to step S30 shown in FIG. 6. In step S30, a pointer N is reset at "0", and individual flags regarding performances are searched for. The CPU 1 determines whether the flag MPF is set or not (step S31). If the CPU 1 determined that the flag MPF is set, the CPU 1 sets an initial address of the model performance data to an address register AD (step S32). If the CPU 1 determines that the flag MPD is reset, the CPU 1 determines whether the flag ZPF is set or not (step S33). If the CPU 1 determines that the flag ZPF is set, the CPU 1 sets an initial address of the actual performance data to the register AD (step S34). If the CPU 1 determines that both the flags MPF and ZPF are reset, the CPU 1 determines whether the flag KPF is set or not (step S35). If the CPU 1 determines that the flag KPF is set, the CPU 1 sets an initial address of the model performance data to the register AD (step S36). Then, the CPU 1 sets data of (AD+N), that is, event start time stored at the initial address, to a register T1 (step S37). The value "0" is set to the register EVST (step S38), and the CPU 1 allows EVST timer interruption (step S39). Then, the flow returns to the main flow.

Figure 7:
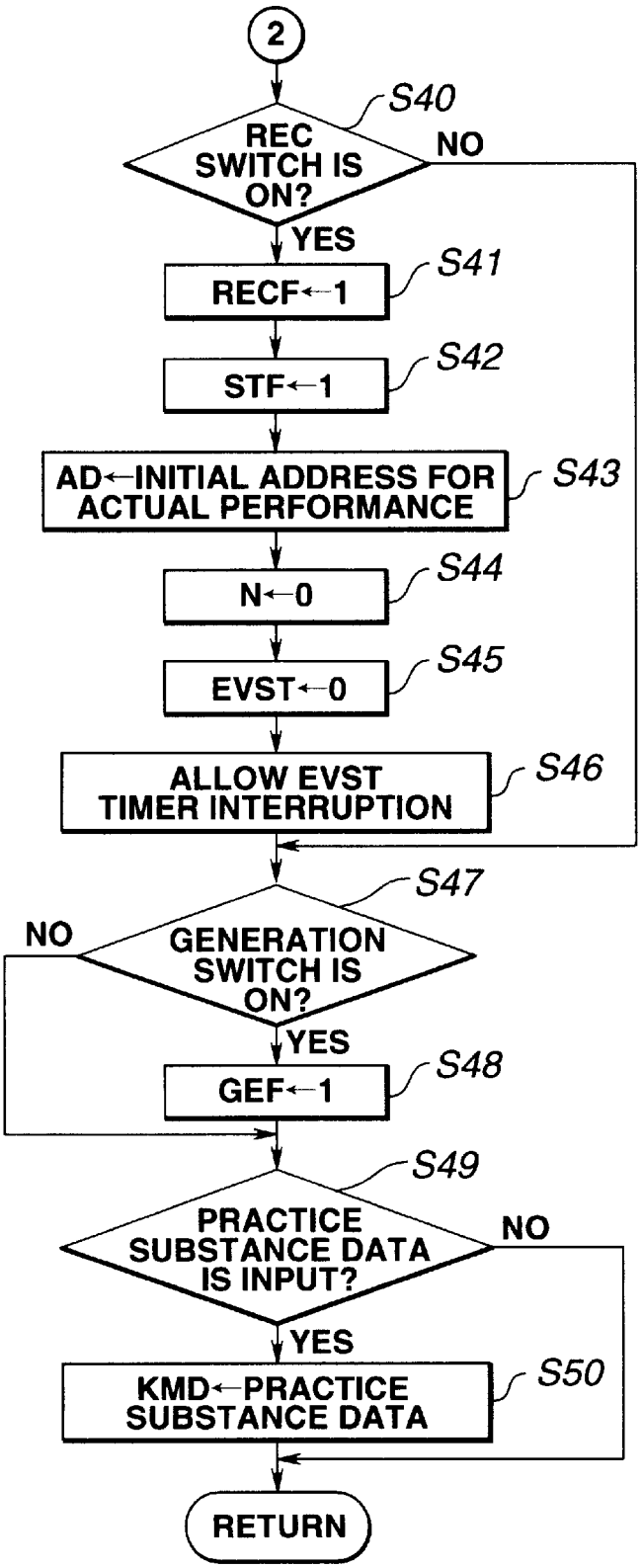

If the CPU 1 determines by step S24 of the flow shown in FIG. 5 that the start switch is not ON, the flow progress to step S40 shown in FIG. 7. In step S40, the CPU 1 determines whether a record switch is ON or not. If the CPU 1 determines that the switch is ON, the flag RECF is set (step S41), and the flag STF is set (step S42). In this case, the play mode is automatically set to the actual performance mode, and the initial address of the actual performance data is set to the register AD (step S43). Then, the pointer N is reset (step S44) and "0" is set to the register EVST, then the CPU 1 allows the EVST timer interruption (step S46). After the inhibition is canceled or it is determined by step S40 that the record switch is not ON, the CPU 1 determines whether a switch for generating the virtual performance data is ON or not (step S47). If the CPU 1 determines that the switch is ON, a flag GEF for generating the virtual performance data is set (step S48). After the flag GEF is set or if the CPU 1 determines by step S47 that the switch is not ON, the CPU 1 determines whether a switch for inputting the practice substance data is ON or not (step S49). In the case where the practice substance data is input, the CPU 1 stores preset practice substance data of a virtual competitor to a register KMD (step S50). Then, the flow returns to the main flow.

Figure 8:
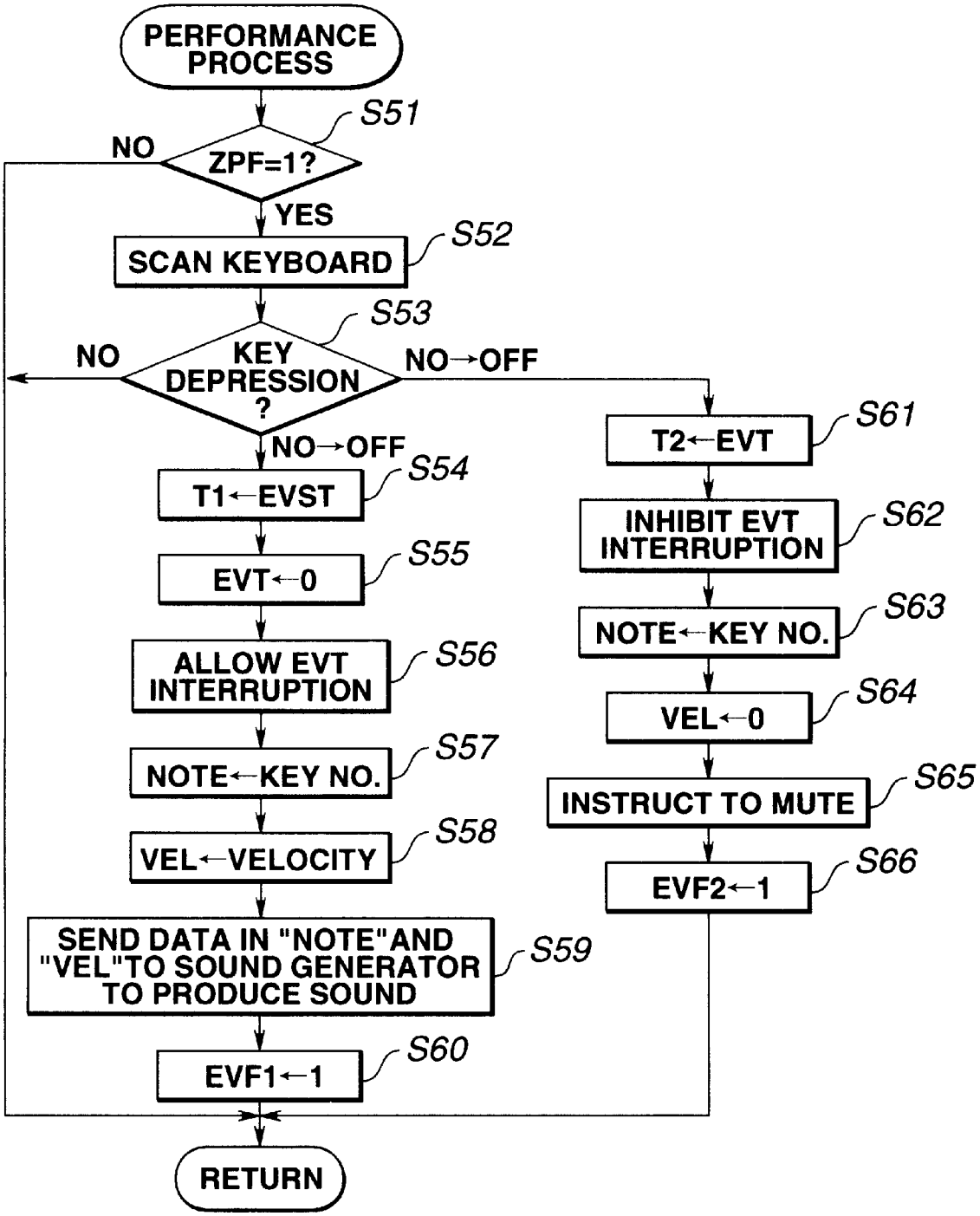
FIG. 8 is a flowchart for explaining the performance step included in the flowchart shown in FIG. 2.

In the performance process (step S4) in the main flow (FIG. 2), as shown in FIG. 8, the CPU 1 determines whether the flag ZPF is set or not (step S51). If the CPU 1 determines that the flag ZPF is reset, the flow returns to the main flow. If the CPU 1 determines that the flag is set, the CPU 1 scans the keyboard (step S52) to detect a key-on event or a key-off event (step S53). If neither the key-on nor key-off event is detected, the flow returns to the main flow.

If the key-on event is detected by step S53, the CPU 1 sets, to the register T1, data which has been set to the register EVST at that time (step S54). The register EVT is reset at "0" (step S55) and the CPU 1 allows the EVT timer interruption (step S56). Then, the CPU 1 sets the key number of the depressed key to a register NOTE (step S57), and sets velocity data to a register VEL (step S58). The CPU 1 sends, to the sound generator 14, the data which has been set to the register NOTE and VEL, in order to command the sound generator 14 to generate sounds (step S59). The CPU 1 sets "1" to a key-on event flag EVF1 (step S60), then the flow returns to the main flow.

If the key-off event is detected by step S53, the CPU 1 sets, to a register T2, the data which has been set to the register EVT at that time (step S61) and allows the EVT timer interruption (step S62). Then, the CPU 1 sets the key number of the key, where the key-off event has occurred, to the register NOTE (step S63) and sets "0" to the register VEL (step S64). The CPU 1 commands the sound generator 14 to mute the sounds (step S65) and sets a key-off event flag EVF2 to "1" (step S66). Then, the flow returns to the main flow.

Figure 9:
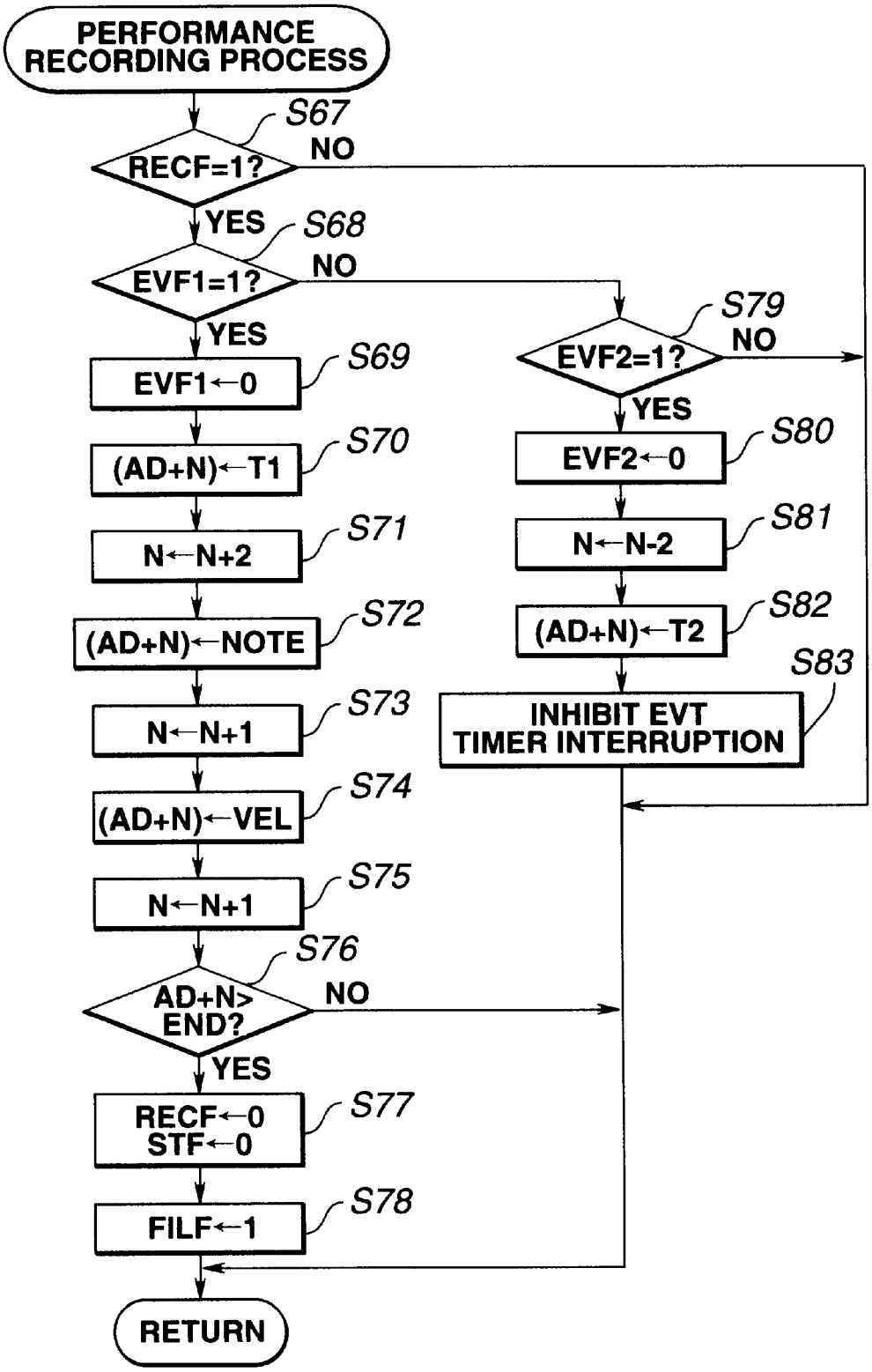
FIG. 9 is a flowchart for explaining the performance recording step included in the flowchart shown in FIG. 2.

In the performance recording process (step S66) of the main flow (FIG. 2), as shown in FIG. 9, the CPU 1 determines whether the flag RECF is set or not (step S67). If the CPU 1 determines that the flag RECF is not set, the flow returns to the main flow without executing the performance recording process. If the CPU 1 determines that the flag RECF is set, the CPU 1 determines whether the key-on event flag EVF1 is set or not (step S68). If the CPU 1 determines that the flag EVF1 is set, the CPU resets the flag EVF1 (step S69). The CPU 1 sets the event start time, stored in the register T1, to the initial address (AD+N) in the player performance data memory 9 (step S70). Then the pointer N is incremented by 2 (step S71). The CPU 1 sets the pitch data, stored in the register NOTE, to address (AD+N) for storing the pitch data (step S72).

The CPU 1 increments the pointer N (step S73) and sets the velocity data in the register VEL to the address (AD+N) for storing the velocity data (step S74). Then the CPU 1 further increments the pointer N (step S75), and determines whether the address AD+N exceeds predetermined data END or not (step S76). If the CPU 1 determines that the address AD+N does not exceed the data END, the flow returns to the main flow. If the CPU 1 determines that the address exceeds the data END, the flags RECF and STF are reset (step S77) and a performance record flag FILF is set (step S78). Then the flow returns to the main flow.

If the CPU 1 determines by step S68 that the key-on event flag EVF1 is reset, the CPU 1 determines whether the key-off event flag EVF2 is set or not (step S79). If the CPU 1 determines that the key-off event flag EVF2 is reset, that is, neither the key-on event nor the key-off event has occured, the flow returns to the main flow without executing the performance recording process. If the CPU 1 determines that the flag EVF2 is set, the CPU 1 resets the flag EVF2 (step S80), decrements the pointer N at the address by 2 (step S81), and sets the event time, stored in the register T2, to the address (AD+N) for storing the event time (step S82). The CPU 1 inhibits the EVT timer interruption (step S83), then the flow returns to the main flow.

In the performance data generating process (step S6) in the main flow (FIG. 2), as shown in FIG. 9, the CPU 1 determines whether the virtual data generation flag GED is set or not (step S84). If the CPU 1 determines that the virtual data generation flag GED is set, the CPU 1 determines whether the performance record flag FILF is set, that is, the actual performance data has been recorded in the player performance data memory 9 or not (step S85). If the CPU 1 determines that the performance record flag FILF is set, the actual performance is analyzed by step S86, as described later with reference to FIG. 11. The virtual performance data is generated by step S87, as described in later with reference to FIG. 12. If the CPU 1 determines by step S84 that the flag GEF is reset or if the CPU 1 determines by step S85 that the flag FILF is reset, the flow returns to the main flow.

Figure 10:
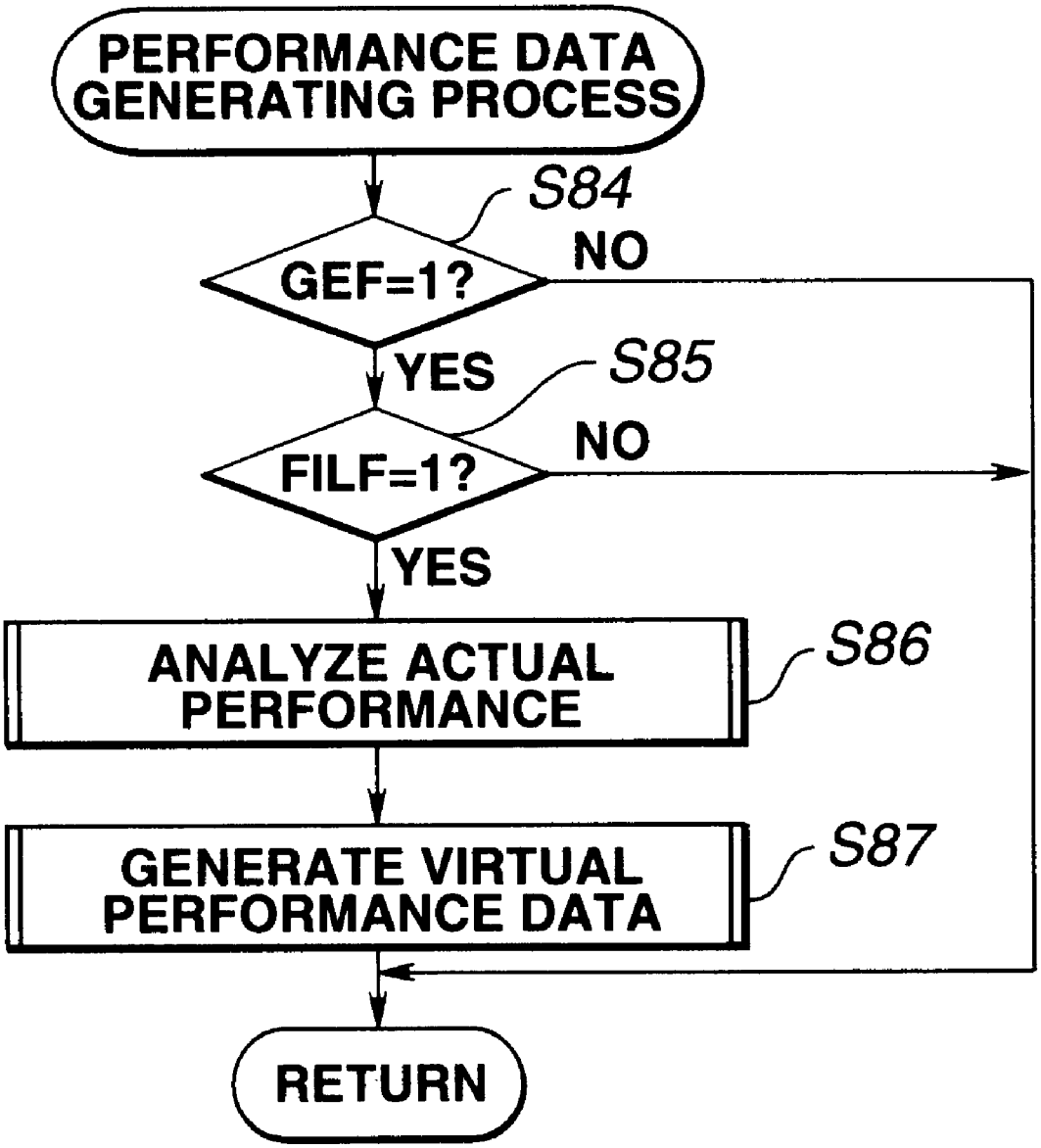
FIG. 10 is a flowchart for explaining the performance data generating step included in the flowchart shown in FIG. 2.
Figure 11:
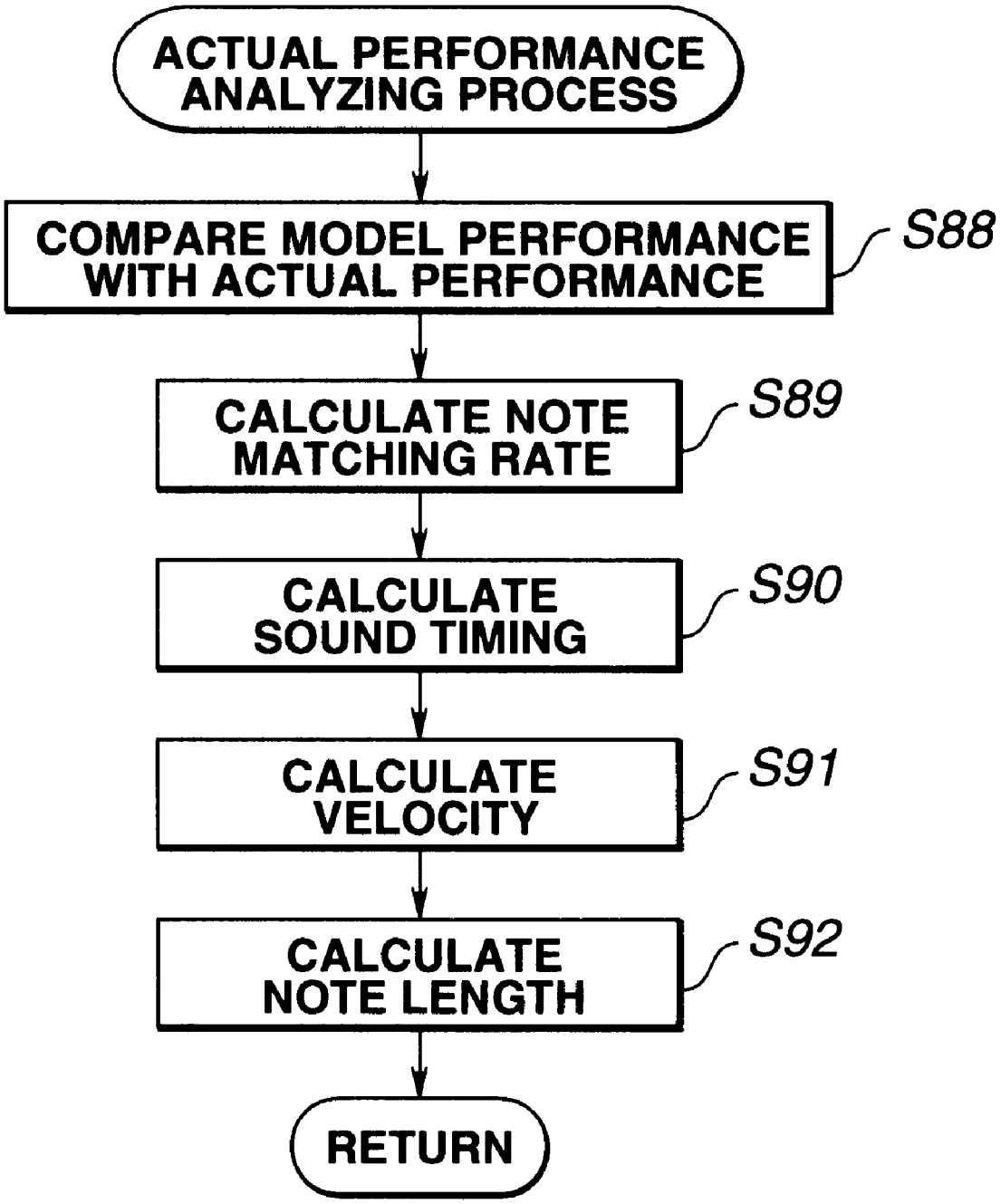
FIG. 11 is a flowchart for explaining the actual performance analyzing step included in the flowchart shown in FIG. 10.

In the actual performance analysis (step S86 in FIG. 10), as shown in FIG. 11, the actual performance is compared with the model performance (step S88). Then, the CPU 1 executes note matching rate calculation (step S89), sound timing calculation (step S90), velocity calculation (step S91) and note duration calculation (step S92) in order. In step S89, an operational coefficient, indicating the rate of the note matching of the actual performance with the model performance, is determined. When the actual performance matches with the model performance (100%), the operational coefficient is 1. If a wrong key depression, an extra key depression, a key depression failure, or the like as shown in FIG. 17, is detected, the coefficient is reduced. In step S90, note duration is determined on the basis of the sound generation timing, velocity and note-off timing. An operational coefficient representing the note duration is determined on the basis of frequency distribution of differences between the actual performance and the model performance, average of the differences between the actual performance and the model performance, and deviation of the differences between the actual performance and the model performance.

Virtual performance data preparation process will now be described in detail. The wrong key depression occurs irregularly and depends on the player's skill. As the player's performance skill increases, the rate of wrong key depression decreases, that is, a value of the note matching rate increases.

To prepare the virtual performance data including data of assumed wrong key depressions, the CPU 1 calculates the number of wrong notes (keys) or the frequency of the wrong key depressions in accordance with the note matching rate which is converted on the basis of the total number of notes and a data modification rate KR included in the model performance data. The CPU 1 randomly selects notes corresponding to the calculated number from all notes of the model performance data. The CPU 1 modifies or deletes the selected notes, or adds extra note before or after each of the selected notes.

In the case where the frequency of the wrong key depressions is calculated, the CPU 1 detects notes corresponding to the frequency and modifies or deletes the detected notes, or add extra note before or after each of the detected notes.

The deviations of the note-on timining, note-off timing and velocity appear randomly during a performance. Or, it is also known that a player tends to have his/her own rate of such deviations. In other words, during a performance played by the player, changing in the timings of the note-on and note-off do not appear, however, his/her note-on and note-off timings tend to be early or late through the performance. Similarly, there are players who play their performances with fast velocity through the performances, and vise versa. To prepare the virtual performance data including data of the note-on timings, the note-off timings and the velocity values which are deviated from those of the model performance data, the CPU 1 previously deviates the note-on and note-off timings of all notes of the model performance data in accordance with a predetermined difference and changes the velocity values of the model performance data note by note.

To execute this process, the CPU 1 obtains the difference of the note-on timings in accordance with the data modification rate KR first. Then, the CPU 1 deviates the note-on timings of all notes in the model performance data in accordance with the difference. In the same manner, the note-off timings of the model performance data are deviated in accordance with the difference.

Moreover, the CPU 1 obtains the difference of the velocity in accordance with the data modification rate KR. Then, the CPU 1 changes the velocity values of all notes in the model performance data in accordance with the obtained difference.

Thus, the virtual performance data is prepared on the basis of the model performance data in accordance with the data modification rate KR.

Figure 12:
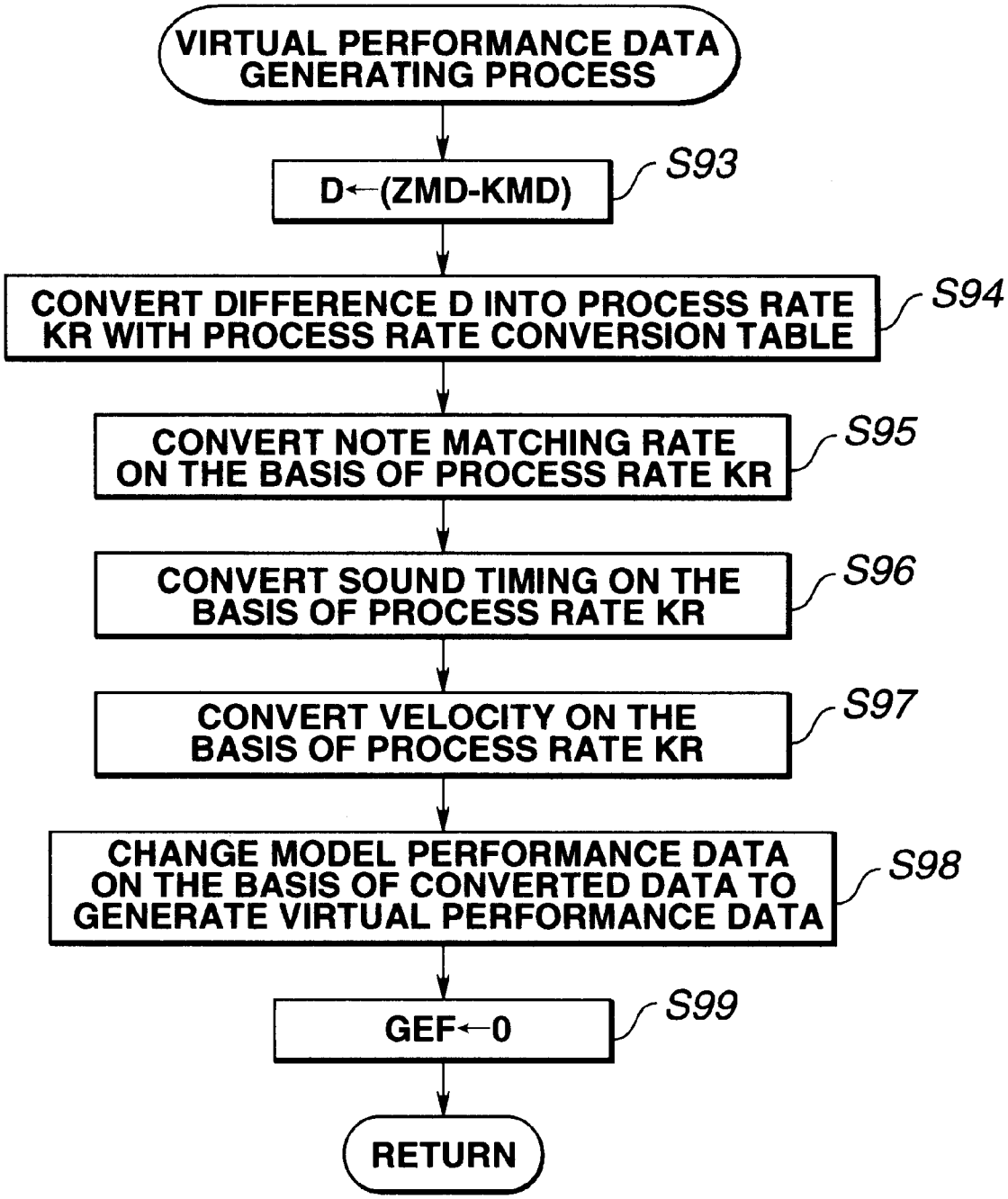
FIG. 12 is a flowchart for explaining the virtual performance data generating step included in the flowchart shown in FIG. 10.
Figure 18:
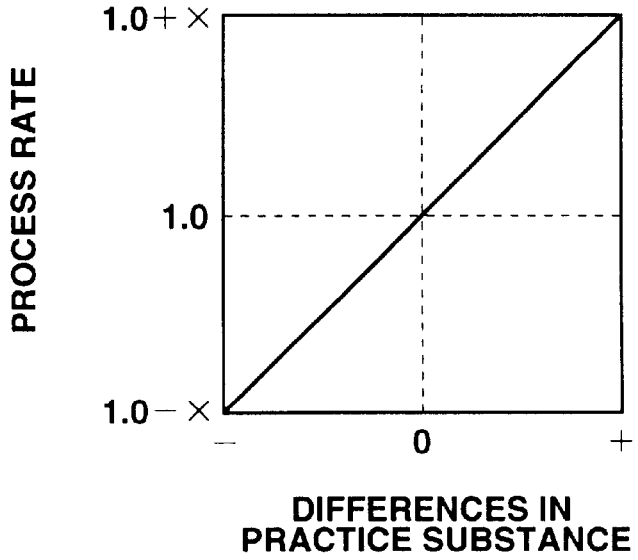
FIG. 18 is a diagram showing a data modification rate conversion table used to generate virtual performance data.

In the virtual performance data generation process by step S87 in FIG. 10, as shown in FIG. 12, the CPU 1 subtracts the preset practice substance data of the virtual competitor in the register KMD from the practice substance data of the actual performance in the register ZMD. The CPU 1 sets the obtained difference value to a register D (step S93). Then the CPU 1 converts the difference value into the data modification rate KR, using a data modification rate conversion table (step S94). As shown in FIG. 18, the data modification rate conversion table shows the data modification rate versus the differences in the practice substance. Then the CPU 1 converts the note matching rate, the sound timing and the velocity on the basis of the data modification rate KR (steps S95, S96 and S97). Based on the converted data, the CPU 1 modifies the model performance data to prepare virtual performance data (step S98). Then the flag GEF is reset (step S99) and the flow returns to the main flow.

Figure 13:
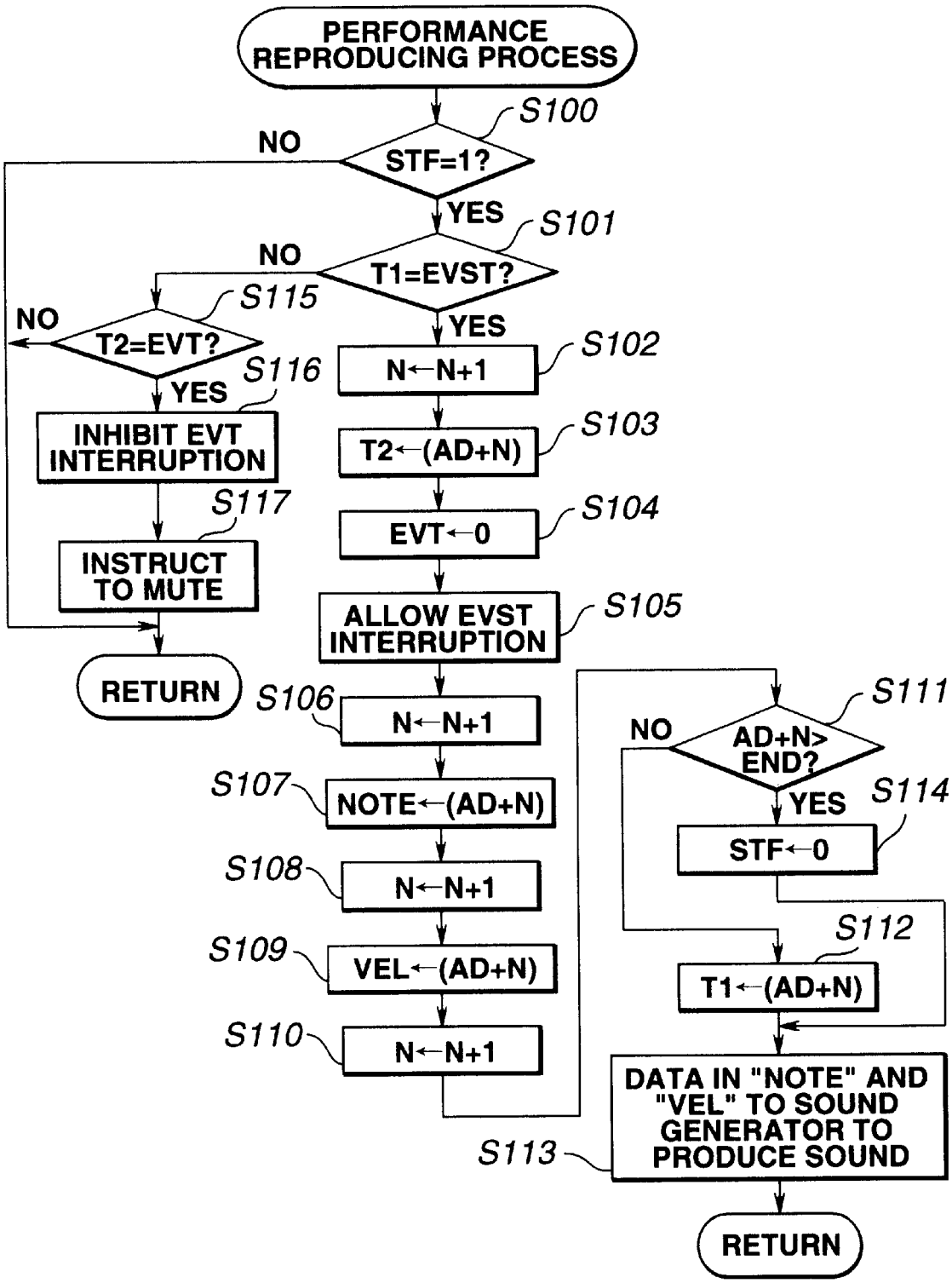
FIG. 13 is a flowchart for explaining the performance reproducing step included in the flowchart shown in FIG. 2.

In the performance reproducing process (step S7) in the main flow shown in FIG. 2, as shown in FIG. 13, the CPU 1 reads out the model performance data, the actual performance data and the virtual performance data from corresponding memories in accordance with the values of the flags MPF, ZPF and KPF which are determined as shown in FIG. 6, and reproduce the read data. In other words, the CPU 1 determines whether the flag STF is set or not as shown in FIG. 13 (step S100), and if the CPU 1 determines that the flag STF is reset, the flow returns to the main flow without executing the performance reproducing process. If the CPU 1 determines that the flag STF is set, the CPU 1 determines whether time data stored in the register EVST matches with the event start time which has been set to the register T1 by step S37 shown in FIG. 6 (step S101). The time data in the register EVST is incremented every time the timer interruption shown in FIG. 3 (B) occurs. If the time data matches with the event start time, the pointer N is incremented (step S102). The CPU 1 sets the event time, stored in the address (AD+N), to the register T2 (step S103). The CPU 1 resets the register EVT (step S104) and allows the EVT interruption (step S105).

The CPU 1 increments the pointer N by one (step S106), and then sets the pitch data, stored in the address (AD+N), to the register NOTE (step S107). The N is further incremented by one (step S108), and then the velocity data at the address (AD+N) is set to the register VEL (step S109). The CPU 1 further increments the pointer N by one (step S10) and determines whether the address AD+N exceeds the data END or not (step S111). If the CPU 1 determines that the address AD+N does not exceed the data END, the CPU 1 sets data, stored in the address (event start time for the next event), to the register T1 (step S112), and send the data, stored in the register NOTE and the register VEL, to the sound generator 14 in order to instruct the sound generator 14 to produce a sound (step S113). If the CPU 1 determines by step S111 that the address AD+N exceeds the data END, the CPU 1 resets the flag STF (step S114), and then the flow proceeds to step S113 for sound producing. After the sound producing step is executed, the flow returns to the main flow.

If the CPU 1 determines by step S101 that the time data in the register EVST does not match with the event start time in the register T1, the CPU 1 determines whether the sound producing step S113 is finished or not. The CPU 1 executes this determination on the basis of determination whether a value of the register EVT matches with the event time in the register T2 (step S115). If the CPU 1 determines that the value does not match with the event time, the CPU 1 determines that the sound production is not finished and the flow returns to the main flow. If the CPU 1 determines that the value matches with the event time, the CPU 1 determines that the sound production has been finished and inhibits the EVT interruption (step S116). Then, the CPU 1 instructs the sound generator 14 to mute the sound (step S117).

According to the above described embodiment, the CPU 1 functions as performance data analyzing means for analyzing the data of the player's actual performance, data generating means for generating the performance data of the virtual competitor in accordance with the result of the analysis carried out by the performance data analyzing means, and performance reproducing means for executing automatic performance on the basis of the virtual performance data. The automatic performance executed by the performance reproducing means enables the player to compare his/her performance with the performance of the virtual competitor. Thus, the player can compete with the virtual competitor or compare his/her musical technique with that of the virtual competitor even if the player practices alone.

The above described embodiment exemplifies the electronic instrument having a keyboard employing the present invention. However, an electronic stringed instrument, an electronic wind instrument, or any other electronic instruments may employ the present invention.

What is claimed is:

1. A performance supporting apparatus comprising:

model performance data receiving means for receiving model performance data;

actual performance data receiving means for receiving actual performance data corresponding to a player's actual performance;

performance data analyzing means for analyzing the actual performance data received by said actual performance data receiving means based on the model performance data received by said model performance data receiving means; and virtual performance data generating means for generating virtual performance data, said virtual performance data generating means including: (i) practice substance detecting means for detecting actual performance practice substance data, and (ii) performance data conversion means for converting the model performance data into the virtual performance data based on the actual performance substance data and a result of the analysis performed by said performance data analyzing means.

2. The performance supporting apparatus according to claim 1, wherein said performance data analyzing means includes:

comparing means for comparing the model performance data with the actual performance data to detect a difference between the model performance data and the actual performance data; and calculation means for calculating an operational coefficient based on the difference detected by said comparing means.

3. The performance supporting apparatus according to claim 2, wherein said virtual performance data generating means includes:

practice substance setting means for setting virtual performance practice substance data;

difference detecting means for detecting a difference between the actual performance practice substance data and the virtual performance practice substance data;

operational coefficient conversion means for converting the operational coefficient calculated by said calculation means in accordance with the difference detected by said difference detection means; and performance data conversion means for converting the model performance data into the virtual performance data in accordance with the operational coefficient converted by said operational coefficient conversion means.

4. The performance supporting apparatus according to claim 3, wherein said operational coefficient conversion means includes data modification rate conversion table means for converting the difference detected by said difference detecting means into a data modification rate, and wherein said operational coefficient conversion means converts the operational coefficient calculated by said calculation means in accordance with the data modification rate converted by said data modification rate conversion means.

5. The performance supporting apparatus according to claim 3, wherein said practice substance detecting means includes:

practice storage means for storing past practice dates and practice duration times;

practice frequency detecting means for detecting a practice frequency during a predetermined period of time in the past based on the past practice dates stored in said practice storage means;

average practice time detecting means for detecting an average practice time during the predetermined period of time in the past based on the practice duration times stored in said practice storage means; and practice substance conversion table means for determining the actual performance practice substance data based on the detected practice frequency and the detected average practice time.

6. The performance supporting apparatus according to claim 5, wherein said practice storage means includes a real time counter for counting real time, and wherein a date corresponding to the real time counted by said real time counter is stored as a practice date each time said performance supporting apparatus is turned on and a value counted by said real time counter is stored as a practice duration time when said performance supporting apparatus is turned off.

7. The performance supporting apparatus according to claim 1, wherein said performance supporting apparatus further comprises model performance data storage means for storing the model performance data, and wherein said model data receiving means receives the model performance data from said model performance storage means.

8. A performance supporting method comprising:

receiving model performance data;

receiving actual performance data corresponding to a player's actual performance;

analyzing the actual performance data based on the model performance data;

detecting actual performance practice substance data; and converting the model performance data into virtual performance data based on the actual performance practice substance data and a result of the analysis of the actual performance data.

9. The performance supporting method according to claim 8, wherein said performance data analyzing step comprises:

comparing the model performance data with the actual performance data to detect a difference between the mode performance data and the actual performance data; and calculating an operational coefficient based on the detected difference between the model performance data and the actual performance data.

10. The performance supporting method according to claim 9, wherein said virtual performance data generating step comprises:

setting virtual performance practice substance;

detecting a difference between the actual performance practice substance data and the virtual performance practice substance data;

converting the calculated operational coefficient in accordance with the detected difference between the actual performance practice substance data and the virtual performance practice substance data; and converting the model performance data into the virtual performance data based on the converted operational coefficient.

11. The performance supporting method according to claim 10, wherein said operational coefficient converting step comprises converting the detected difference between the actual performance practice substance data and the virtual performance practice substance data into a data modification rate, and wherein said calculated operational coefficient is converted based on the data modification rate.

12. The performance supporting method according to claim 10, wherein said practice substance detecting step comprises:

storing past practice dates and practice duration times;

detecting a practice frequency during a predetermined period of time in the past based on the stored past practice dates;

detecting an average practice time during the predetermined period of time in the past based on the stored practice duration times; and determining the actual performance practice substance data based on the detected practice frequency and the detected average practice time.

13. The performance supporting method according to claim 12, wherein said practice storing step comprises counting real times and wherein a date corresponding to the counted real time is stored as a practice date each time an apparatus employing said performance supporting method is started and a counted real time value is stored as a practice duration time the apparatus employing said performance supporting method is turned off.

14. The performance supporting method according to claim 8, wherein said model performance data receiving step comprises receiving stored model performance data.

15. A recording medium storing a performance supporting program for causing a computer to:

receive model performance data;

receive actual performance data corresponding to a player's actual performance;

analyze the received actual performance data based on the received model performance data;

detect actual performance practice substance data; and convert the model performance data into virtual performance data based on the actual performance practice substance data and a result of the analysis.

16. The recording medium according to claim 15, wherein said program causes said computer, while analyzing said performance data, to:

compare the model performance data with the actual performance data to detect a difference between the model perfomance data and the actual performance data; and calculate an operational coefficient based on the detected difference between the model performance data and the actual performance data.

17. The recording medium according to claim 16, wherein said program causes said computer, while generating the virtual performance data, to:

set virtual performance practice substance data;

detect a difference between the actual performance practice substance data and the virtual performance practice substance data;

convert the calculated operational coefficient based on the detected difference between the actual performance practice substance data and the virtual performance practice substance data; and convert the model performance data into the virtual performance data based on the converted operational coefficient.

18. The recording medium according to claim 17, wherein said program causes said computer, while converting the operational coefficient, to:

convert the detected difference between the actual performance practice substance data and the virtual performance practice substance data into a data modification rate; and convert the calculated operational coefficient based on the data modification rate.

19. The recording medium according to claim 17, wherein said program causes said computer, while detecting the actual performance practice substance data, to:

store past practice dates and practice duration times;

detect a practice frequency during a predetermined period of time in the past based on the stored past practice dates;

detect an average practice time during the predetermined period of time in the past based on the stored past practice duration times; and determine the actual performance practice substance data base on the detected practice frequency and the detected average practice time.

20. The recording medium according to claim 19, wherein said program causes said computer to:

store, as a practice date, a date corresponding to a real time counted by said computer each time said program is activated; and store, as a practice duration time, a real time value counted by said computer when said program ends.

21. The recording medium according to claim 20, wherein said program causes said computer to receive the model performance data from model performance data storage means included in said computer.

* * * * *

UNITED STATES PATENT AND TRADEMARK OFFICE

CERTIFICATE OF CORRECTION

PATENT NO. : 5,955,692

DATED : September 21, 1999

INVENTOR(S) : Ryutaro HAYASHI

It is certified that error appears in the above-indentified patent and that said Letters Patent is hereby corrected as shown below:

Column 11, line 34, (claim 10, line 4), after "substance" insert --data--;

Column 12, line 3 (claim 13, line 3), change "times" to --time--.

Signed and Sealed this

Twenty-sixth Day of December, 2000

*Attest:*

*Attesting Officer*

Q. TODD DICKINSON

*Director of Patents and Trademarks*